US009304443B2

(12) United States Patent
Murayama

(10) Patent No.: US 9,304,443 B2
(45) Date of Patent: Apr. 5, 2016

(54) IMAGE FORMING APPARATUS FOR AGITATING TONER BEFORE IMAGE FORMING OPERATION IS PERFORMED

(71) Applicant: BROTHER KOGYO KABUSHIKI KAISHA, Nagoya-shi, Aichi-ken (JP)

(72) Inventor: Kentaro Murayama, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/628,813

(22) Filed: Feb. 23, 2015

(65) Prior Publication Data

US 2015/0277288 A1 Oct. 1, 2015

(30) Foreign Application Priority Data

Mar. 26, 2014 (JP) ..... 2014-063865

(51) Int. Cl.

| | |
|---|---|
| ***G03G 21/20*** | (2006.01) |
| ***G03G 15/08*** | (2006.01) |
| *G03G 15/16* | (2006.01) |
| *G03G 15/02* | (2006.01) |
| *G03G 15/00* | (2006.01) |

(52) U.S. Cl.

CPC ..... *G03G 15/0889* (2013.01); *G03G 15/0865* (2013.01); *G03G 21/203* (2013.01); *G03G 15/0266* (2013.01); *G03G 15/1675* (2013.01); *G03G 15/5033* (2013.01); *G03G 21/20* (2013.01); *G03G 2215/00084* (2013.01); *G03G 2215/0802* (2013.01)

(58) Field of Classification Search

CPC ..... G03G 21/20

USPC ..... 399/44

See application file for complete search history.

(56) References Cited

U.S. PATENT DOCUMENTS

| | | | | | |
|---|---|---|---|---|---|
| 5,974,280 | A * | 10/1999 | Takesue et al. | ..... | 399/62 |
| 6,055,388 | A * | 4/2000 | Watanabe et al. | ..... | 399/58 |
| 2004/0218937 | A1* | 11/2004 | Choi | ..... | 399/27 |
| 2007/0122168 | A1* | 5/2007 | Tanaka et al. | ..... | 399/27 |
| 2007/0286617 | A1* | 12/2007 | Tanaka et al. | ..... | 399/30 |
| 2008/0050152 | A1* | 2/2008 | Lee et al. | ..... | 399/254 |
| 2008/0292370 | A1* | 11/2008 | Murayama | ..... | 399/301 |
| 2009/0116858 | A1* | 5/2009 | Tomita | ..... | 399/27 |

(Continued)

FOREIGN PATENT DOCUMENTS

| | | | | |
|---|---|---|---|---|
| JP | 2010-145956 | * | 7/2010 | ..... G03G 15/00 |
| JP | 2010-145956 | A | 7/2010 | |

(Continued)

*Primary Examiner* — Clayton E LaBalle
*Assistant Examiner* — Kevin Butler
(74) *Attorney, Agent, or Firm* — Merchant & Gould P.C.

(57) ABSTRACT

In an image forming apparatus, an agitator agitates the toner in a target agitation amount before the image forming portion forms the image. The target agitation amount represents an amount of actions of agitation imparted upon the toner by the agitator. A processor is configured to: obtain at least one of a degradation level of the toner, the image to be formed, a non-agitation time period during which the agitator has not agitated the toner; set the target agitation amount based on the at least one of the degradation level of the toner, the image to be formed, and the non-agitation time period; perform agitating the toner in the target agitation amount by the agitator; and control the image forming portion to form the image after the agitator agitates the toner in the target agitation amount.

10 Claims, 6 Drawing Sheets

(56) References Cited

U.S. PATENT DOCUMENTS

| | | | | |
|---|---|---|---|---|
| 2009/0162110 | A1* | 6/2009 | Murayama | 399/301 |
| 2009/0162111 | A1* | 6/2009 | Murayama | 399/301 |
| 2009/0162112 | A1* | 6/2009 | Murayama | 399/301 |
| 2011/0026959 | A1* | 2/2011 | Itaya | 399/53 |
| 2011/0182602 | A1* | 7/2011 | Suzuki | 399/49 |
| 2011/0317175 | A1* | 12/2011 | Murayama et al. | 358/1.2 |
| 2011/0317182 | A1* | 12/2011 | Murayama et al. | 358/1.9 |
| 2011/0318032 | A1* | 12/2011 | Murayama et al. | 399/49 |
| 2012/0163843 | A1* | 6/2012 | Murayama | 399/49 |
| 2012/0163849 | A1* | 6/2012 | Murayama | 399/71 |
| 2012/0237232 | A1* | 9/2012 | Goto | 399/49 |
| 2012/0243014 | A1* | 9/2012 | Goto et al. | 358/1.12 |
| 2012/0251135 | A1* | 10/2012 | Murayama | 399/27 |

FOREIGN PATENT DOCUMENTS

| | | | | |
|---|---|---|---|---|
| JP | 2011-128526 | * | 6/2011 | G03G 15/08 |
| JP | 2011-128526 | A | 6/2011 | |

* cited by examiner

IMAGE FORMING APPARATUS FOR AGITATING TONER BEFORE IMAGE FORMING OPERATION IS PERFORMED

CROSS REFERENCE TO RELATED APPLICATION

This application claims priority from Japanese Patent Application No. 2014-063865 filed Mar. 26, 2014. The entire content of the priority application is incorporated herein by reference.

TECHNICAL FIELD

The present invention relates to an image forming apparatus that forms an image using toner and, more particularly, to technology concerning toner agitation.

BACKGROUND

A conventional image forming apparatus forms an image using toner. In this image forming apparatus, the toner in a developing device is agitated before an image forming operation so as to stabilize a toner charge amount.

SUMMARY

It is conceivable that the toner charge amount becomes stable when a specific agitation amount prior to the image forming operation is large. In this case, however, a long time is taken until the image forming operation is started. On the other hand, when the specific agitation amount is small, the toner charge amount is likely to be insufficient, resulting in unstable image quality. There are some factors causing a fluctuation of the toner charge amount, and there is still room for improvement in setting an adequate specific agitation amount.

An object of the present invention is to provide an image forming apparatus that forms an image by using toner, in which an specific agitation amount before the image forming operation can be set to an appropriate amount.

In order to attain the above and other objects, the invention provides an image forming apparatus. The image forming apparatus may include a container, an image forming portion, an agitator, and a processor. The container may accommodate toner. The image forming portion may be configured to form an image by using the toner in the container. The agitator may be configured to agitate the toner in a target agitation amount before the image forming portion forms the image. The target agitation amount may represent an amount of actions of agitation imparted upon the toner by the agitator. The processor may be configured to: obtain at least one of a degradation level of the toner, a type of the image to be formed, and a non-agitation time period during which the agitator has not agitated the toner; set the target agitation amount based on the at least one of the degradation level of the toner, the image to be formed, and the non-agitation time period; perform agitating the toner in the target agitation amount by the agitator; and control the image forming portion to form the image after the agitator agitates the toner in the target agitation amount.

According to another aspect, the present invention provides a method for forming an image. The method may include: obtaining at least one of a degradation level of the toner, a type of an image to be formed, and a non-agitation time period during which the toner has not been not agitated; setting the target agitation amount based on the at least one of the degradation level of the toner, the type of the image to be formed, and the non-agitation time period; agitating the toner in the target agitation amount; and forming the image after the toner is agitated in the target agitation amount.

According to another aspect, the present invention provides a non-transitory computer readable storage medium storing a set of program instructions installed on and executed by a computer for controlling an image reading apparatus comprising: a container accommodating toner; an image forming portion configured to form an image by using the toner in the container; and an agitator configured to agitate the toner in a target agitation amount before the image forming portion forms the image, the target agitation amount representing an amount of agitation imparted upon the toner by the agitator. The program instructions may include obtaining at least one of a degradation level of the toner, a type of the image to be formed, a non-agitation time period during which the agitator has not agitated the toner; setting the target agitation amount based on the at least one of the degradation level of the toner, the type of the image to be formed, and the non-agitation time period; performing agitating the toner in the target agitation amount by the agitator; and controlling the image forming portion to form the image after the agitator agitates the toner in the target agitation amount.

BRIEF DESCRIPTION OF THE DRAWINGS

The particular features and advantages of the invention as well as other objects will become apparent from the following description taken in connection with the accompanying drawings, in which.

DETAILED DESCRIPTION

A printer 100 according to an embodiment of the invention will be described while referring to the accompanying drawings. The printer 100 is configured to form an image by an electricphotographic process.

Figure 1:
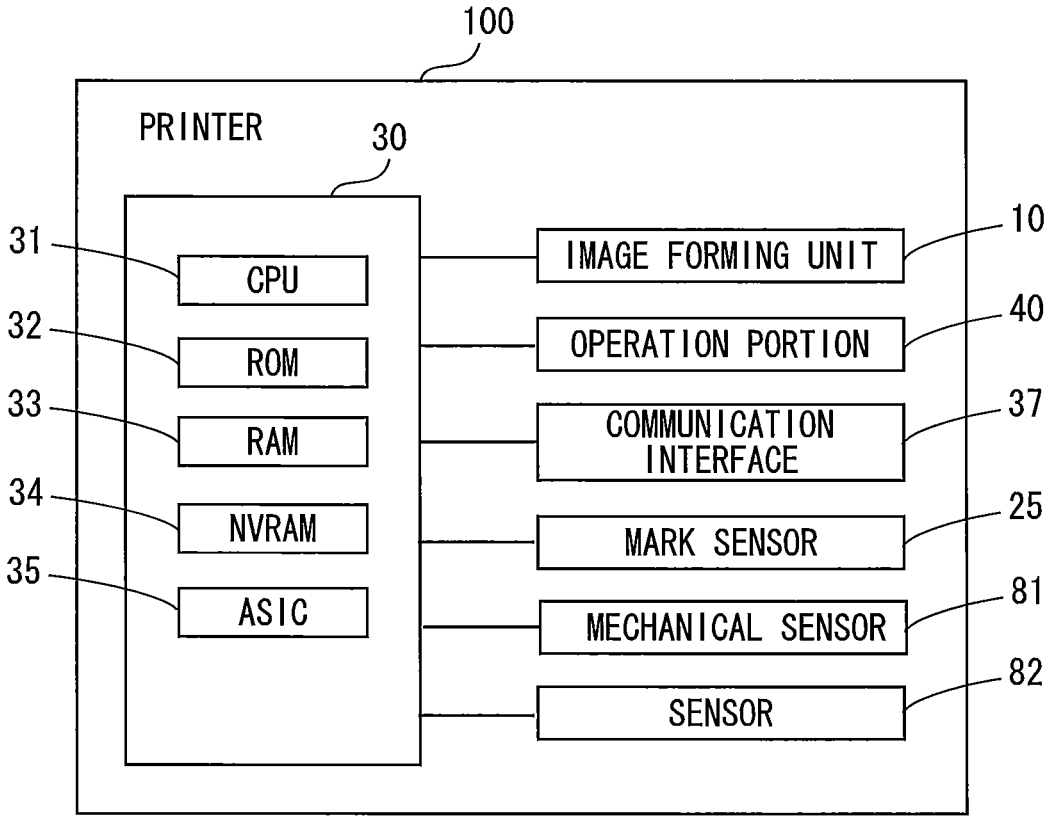
FIG. 1 is a block diagram illustrating an electric configuration of printer according to an embodiment.

As shown in FIG. 1, the printer 100 includes a controller 30. The controller 30 includes a CPU 31, a ROM 32, a RAM 33, a NVRAM (nonvolatile RAM) 34, and an ASIC (Application Specific Integrated Circuit) 35. The printer 100 further includes an image forming unit 10, an operation portion 40, a communication interface 37, a mark sensor 25, a mechanical sensor 81, and a sensor 82, which are controlled by a CPU 31. The image forming unit 10 forms an image by an electrophotographic system. The operation portion 40 receives an input operation from a user. The communication interface 37 is used for connecting to an external device. A controller 30 of FIG. 1 is a generic term referring to hardware, such as the CPU 31, used for controlling the printer 100 and does not always indicate a single hardware actually existing in the printer 100.

The ROM 32 stores various control programs for controlling the printer 100, various settings, initial values, and the like. The RAM 33 is used as a working area where various control programs are read or a storage area where image data is temporarily stored.

The CPU 31 controls components of the printer 100 while storing processing results thereof in the RAM 33 or the NVRAM 34 according to a signal transmitted from the control program read from the ROM 32 or various sensors. The CPU 31 is an example of a processor. Alternatively, the controller 30 or the ASIC 35 may serve as the processor.

The communication interface 37 is hardware that can perform communication with an external device. For example, the communication interface 37 is a wired LAN interface, a wireless LAN interface, a serial communication interface, a parallel communication interface, or a facsimile interface. The printer 100 can receive a job instructing the image forming unit 10 to form an image from the external device through the communication interface 37.

Figure 2:
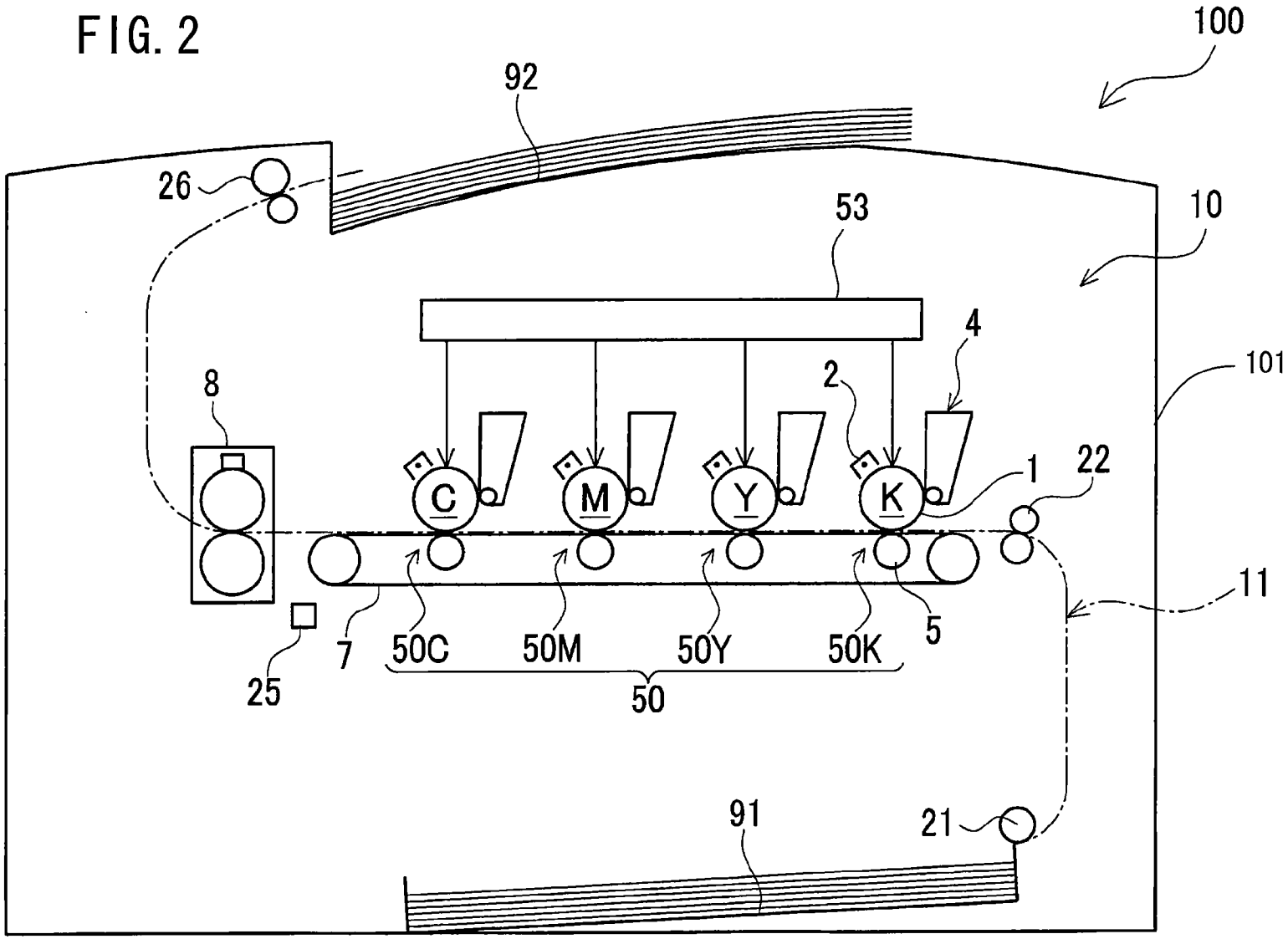
FIG. 2 is a cross section showing an internal structure of the printer shown in FIG. 1.

As shown in FIG. 2, the printer 100 includes a casing 101. The image forming unit 10 is provided in the casing 101. The operation portion 40 is provided on the casing 101 and includes various buttons for receiving an input operation from a user and a touch panel for displaying a message or setting content. For example, the various buttons include an execution button for making the image forming unit 10 forms an image and a cancel button for inputting an image forming cancel command. The operation portion 40 can receive various inputs also when a user touches a touch panel with his or her finger.

A configuration of the image forming unit 10 of the printer 100 will be explained with reference to FIG. 2. The image forming unit 10 includes a process unit 50, an exposure device 53, a fixing device 8, a sheet supply tray 91, a sheet discharge tray 92, and a conveying belt 7. The process unit 50 forms a toner image by an electrophotographic system and transfers the toner image onto a sheet. The exposure device 53 irradiates the process unit 50 with light. The fixing device 8 fixes unfixed toner on the sheet. Sheets before image transfer are placed on the sheet supply tray 91. Sheets after image transfer is placed on the sheet discharge tray 92. The conveying belt 7 conveys the sheet to a transfer position of the process unit 50 from the sheet supply tray 91.

The printer 100 includes a conveying path 11 (indicated by a dashed line of FIG. 2). The conveying path 11 has a substantially S-like shape such that the sheet on the sheet supply tray 91 positioned at a bottom of the printer 100 is guided to the sheet discharge tray 92 positioned at an upper portion of the printer 100, via a sheet supply roller 21, a registration roller 22, the process unit 50, the fixing device 8, and a discharge roller 26.

The process unit 50 is detachably mountable in the casing 101. The process unit 50 can form a color image and has process units 50C, 50M, 50Y, and 50K. The process units 50C, 50M, 50Y, and 50K respectively corresponds to colors of cyan (C), magenta (M), yellow (Y), and black (K). That is, the process unit 50C forms an image of color C, the process unit 50M forms an image of color M, the process unit 50Y forms an image of color Y, and the process unit 50K forms an image of color K. The process units 50C, 50M, 50Y, and 50K are arranged side by side, at equal intervals, in this order from a downstream side in a sheet conveying direction. The arrangement order of the process units is not limited to this.

The process unit 50K includes a photoconductive member (photosensitive drum) 1 having a drum shape (cylindrical shape), a charging device 2 that uniformly charges a surface of the photosensitive member 1, a developing device 4 that develops an electrostatic latent image on the photosensitive member 1 by using toner. The printer 100 includes transfer devices (transfer rollers) 5. One of the transfer devices 5 is disposed below each of the process units 50C, 50M, 50Y, and 50K with the conveying belt 7 interposed therebetween.

That is, the photosensitive member 1 and the transfer device 5 are disposed so as to contact the conveying belt 7. The process unit 50K, in cooperation with the corresponding transfer device 5, transfers a toner image on the photosensitive member 1 onto the sheet or the conveying belt 7. The process units 50C, 50M, and 50Y also have the same configuration as that of the process unit 50K.

Figure 3:
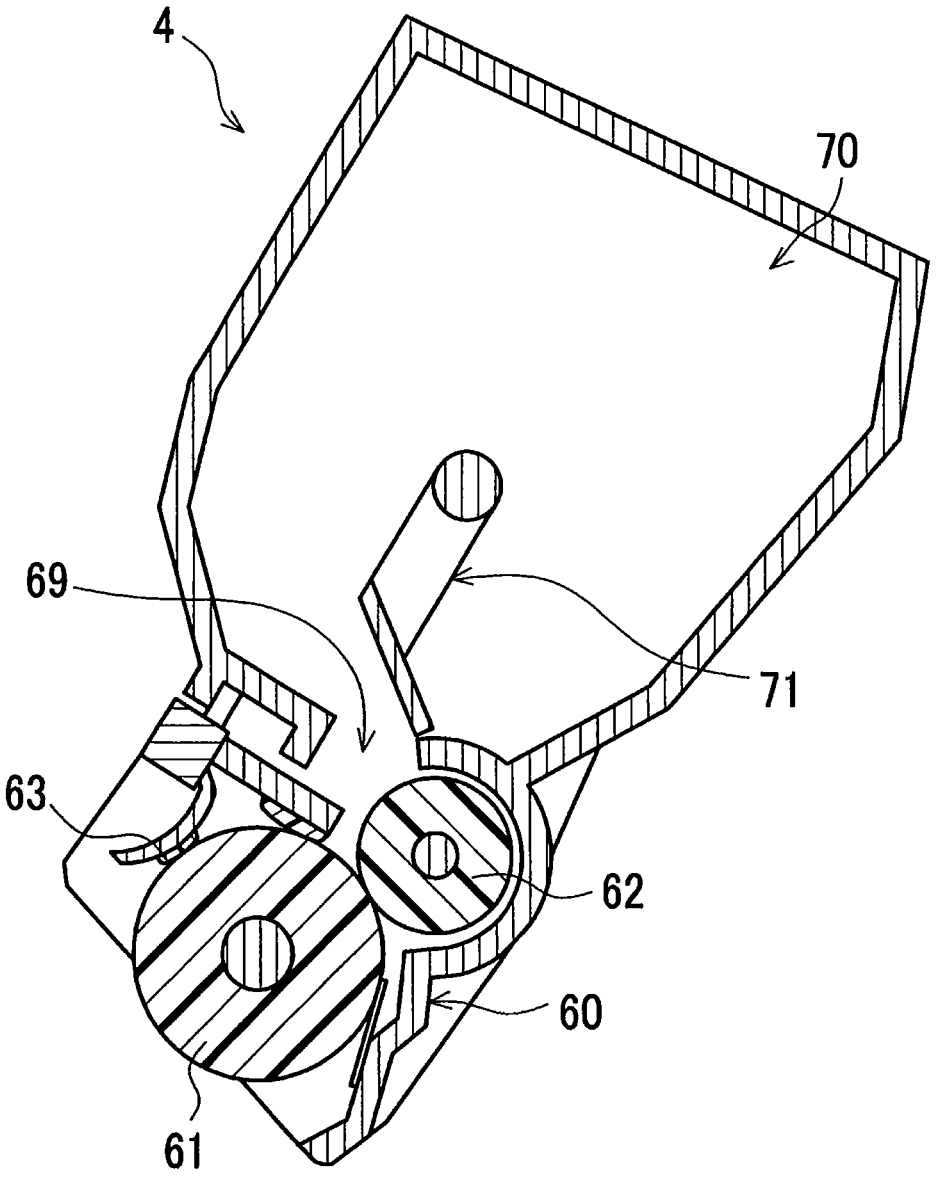
FIG. 3 is a cross section illustrating a process unit according to the embodiment.

Specifically, as illustrated in FIG. 3, the developing device 4 includes a developing unit 60 and a toner accommodating container 70 which can communicate with each other through a supply port 69. In the embodiment, non-magnetic, single-component toner is accommodated in the toner accommodating container 70 as a developing agent. The toner accommodating container 70 is an example of a container.

The developing unit 60 includes a developing roller 61 that carries toner and feeds the toner to the photosensitive member 1, a toner supply roller 62 that supplies the toner to the developing roller 61 and scrapes the toner on the developing roller 61, and a regulation member 63 that regulates a thickness of the toner on the developing roller 61 and charges the toner.

The toner accommodating container 70 is provided with an agitator 71 for agitating the toner. The agitator 71 is rotated by a motor (not shown) to agitate the toner inside the toner accommodating container 70. The agitator 71 is an example of an agitator of the invention. A part of the agitated toner is discharged toward the developing unit 60 through the supply port 69. The toner accommodating container 70 may be detachable from the process unit 50. In other words, the toner accommodating container 70 may be separable from the developing unit 60.

The toner discharged from the supply port 69 to the developing unit 60 is supplied to the developing roller 61 by rotation of the toner supply roller 62. At this time, the toner is friction-charged between the toner supply roller 62 and the developing roller 61. The toner supplied onto the developing roller 61 enters between the regulation member 63 and the developing roller 61 with rotation of the developing roller 61 and is reduced in thickness while being friction-charged. A part of the toner on the developing roller 61 at a position opposed to the photosensitive member 1 is moved to the photosensitive member 1 and develops the electrostatic latent image formed on the photosensitive member 1.

The mechanical sensor 81 is used to determine whether a new process unit 50 is mounted in the printer 100. Specifically, the process unit 50 include a movable part movable between a first position and a second position. The mechanical sensor 81 can detect a position of the movable part of the process unit 50. In a case where the toner accommodating container 70 is detachable from the process unit 50, the toner accommodating container may include a movable part movable between a first position and a second position. And, the mechanical sensor 81 may detect the movable part of the mounted toner accommodating container 70 in order to determine whether a new toner accommodating container 70 is mounted in the process unit 70, that is, a new toner accommodating portion is mounted in the casing 101.

In each of the process units 50C, 50M, 50Y, and 50K shown in FIG. 2, the surface of the photosensitive member 1 is uniformly charged by the charging device 2 and is thereafter exposed to light from the exposure device 53, whereby the electrostatic latent image corresponding to an intended image subject to the image formation is formed on the surface of the photosensitive member 1. The toner is supplied to the photosensitive member 1 from the developing device 4 (specifically, the developing roller 61). As a result, the electrostatic latent image on the surface of the photosensitive member 1 is visualized as a toner image.

The image forming unit 10 picks up the sheets placed on the sheet supply tray 91 one by one and feeds the sheet onto the conveying belt 7. The process unit 50, in cooperation with the transfer device 50, transfers the formed toner image onto the sheet. Here, in color printing, the toner image is formed by each of the process units 50C, 50M, 50Y, and 50K, and the formed toner images are superimposed on the sheet. In monochrome printing, the toner image is formed by only the process unit 50K, and is transferred onto the sheet. Thereafter, the sheet onto which the toner image is transferred is conveyed to the fixing device 8, and the toner image is thermally fixed onto the sheet by the fixing device 8. The resultant sheet is discharged to the sheet discharge tray 92.

The printer 100 performs a correction process so as to prevent density unevenness or displacement from occurring in the images formed by each of the process units 50C, 50M, 50Y, and 50K. The correction process is performed as follows. Each of the process units 50C, 50M, 50Y, and 50K transfers and forms correction marks onto the conveying belt 7. The CPU 31 obtains correction values determined based on a detection result of the marks. In order to detect the marks, the mark sensor 25 is disposed downstream of the process units 50C, 50M, 50Y, and 50K and upstream of the fixing device 8 in the sheet conveying direction. The mark sensor 25 detects the correction marks formed on the conveying belt 7.

Figure 4:
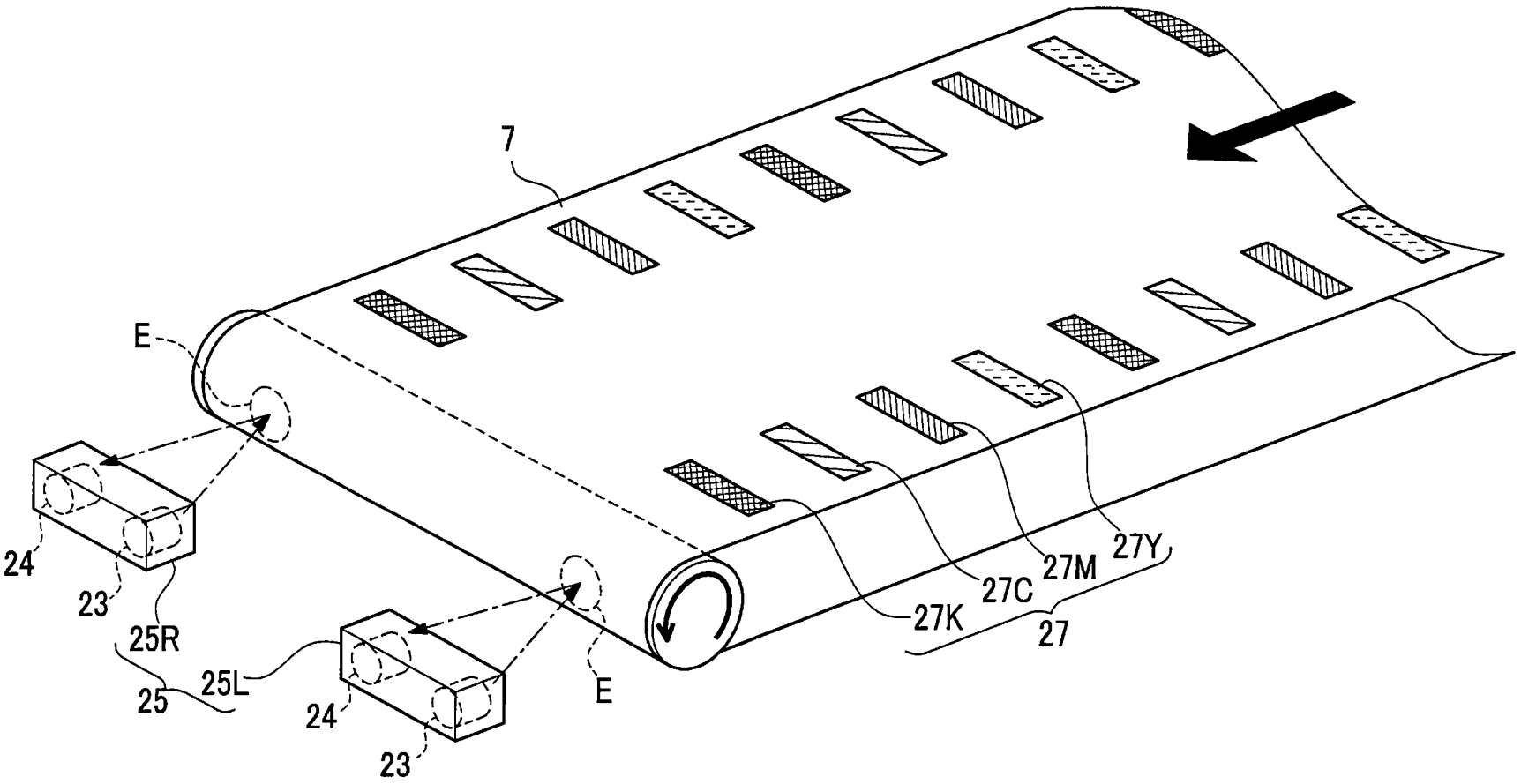
FIG. 4 is an explanatory diagram illustrating an arrangement of a mark sensor according to the embodiment.

Specifically, as illustrated in FIG. 4, the mark sensor 25 includes two sensors 25R and 25L. The sensor 25R is disposed on a right side of the conveying belt 7 in a width direction thereof and the sensor 25L is disposed on a left side thereof. Each of the sensors 25R and 25L is a reflective type optical sensor provided with a pair of a light emitting element 23 such as an LED and a light receiving element 24 such as a phototransistor. As illustrated in FIG. 4, each light emitting element 23 of the mark sensors 25R and 25L diagonally irradiates a region E (see a circular frame written by a dashed-line) on a surface of the conveying belt 7 with light, and the corresponding light receiving element 24 receives the light reflected by the conveying belt 7 or a mark on the conveying belt 7. The correction mark can be detected by a difference between a light receiving amount when the correction mark 27 passes the region E and a light receiving amount directly reflected from the surface of the conveying belt 7. Here, the mark 27 of FIG. 4 is an example of a mark for a displacement correction.

The following describes various correction process executed in the printer 100. Examples of the correction process executed by the printer 100 according to the embodiment include a displacement correction, a developing bias correction, and a gamma correction. The correction process is not limited to these examples.

The displacement correction acquires correction values for adjustment of a dynamic displacement of an image position and a static displacement of an image position. The dynamic displacement of the image position is caused by eccentricity of the photosensitive member 1 or rollers (rollers 21, 22, and other conveying rollers provided in the printer 100 (not shown)), or by deviation of a pitch of gears provided in the printer 100 (not shown) that rotate the photosensitive member 1 or these rollers. The static displacement of the image position is caused by displacement of an installation position of the photosensitive member 1 or the exposure device 53. In the displacement correction, the printer 100 forms marks 27K, 27C, 27M, and 27Y as illustrated in FIG. 4. For example, the marks of respective colors are elongated in a main scanning direction (the widthwise direction of the conveying belt 7), and arranged side by side in a sub-scanning direction orthogonal to the main scanning direction. That is, the marks of different colors are adjacent to one another in the sub-scanning direction. The mark sensor 25 reads these marks. The CPU 31 calculates intervals between the marks, and thereby acquires a periodic displacement amount that periodically emerges or a displacement amount between the colors.

The developing bias correction acquires correction values for adjustment of a deviation between an ideal density specified by the printer 100 and a density of the actually formed mark. For this developing bias correction, the printer forms a mark of a prescribed density (e.g., 100%) for each color. The mark sensor 25 reads these marks. The CPU 31 calculates an actual density based on an amount of light received by the mark sensor 25, and thereby acquires developing bias correction values to bring the actual density close to the ideal density.

The gamma correction corrects a deviation between a density (indicated gradation level) indicated by an external computer and an output density of the printer 100 itself. For this gamma correction, the printer 100 forms, for each colors, a plurality of marks having different densities at prescribed density intervals (e.g., 20%, 40%, 60%, 80%, 100%). The mark sensor 25 reads these marks. The CPU 31 calculates an actual density based on an amount of light received by the mark sensor 25, and thereby specifies characteristics about changes of the densities for each color from a relative relationship in the densities between the marks. Further, the CPU 31 creates a relative relationship table including relationships between the characteristics about changes of the densities and the indicated gradation levels of the external computer.

The density correction for suppressing the density unevenness includes the developing bias correction and the gamma correction, described above. Of these, the developing bias correction corrects a density deviation over all gradation levels. That is, a density deviation is insufficient or excessive density over all gradation levels. The developing bias correction corrects this density deviation. On the other hand, the gamma correction corrects a density deviation (insufficient or excessive density) occurring in each gradation level and appropriately changes the density according to a change in the gradation level.

A plurality of correction process execution conditions are set for each correction process. For example, execution conditions for each correction process may include: a condition that a cover is opened; a condition that a power supply is input; a condition that a user instruction is input; a condition that the printer 100 prints the number of sheets larger than or equal to a prescribed number; a condition that amount (or number) of rotations of the agitator 71 is equal to or higher than a threshold value; a condition that a continuous activation time of the printer 100 is equal to or higher than a threshold value; and a condition that environmental conditions (humidity, temperature, and etc.) are changed. Or, a combination of these conditions may be used as an execution condition of each correction process. For example, an execution process of one correction process may be one of the condition that a power supply is input and the condition that a user instruction is input. In this case, when condition that a power supply is input or when a user instruction is input, the execution condition is met. Alternatively, one correction process may be a combination of the condition that a power supply is input and the condition that a user instruction is input. In this case, both when a power supply is input and when a user instruction is input, the execution condition is met. The sensor 82 detects the environmental conditions.

If the density of each mark has the deviation, although the marks are formed on the same image forming position, a variation occurs in the amount of light received by the mark sensor 25. Thus, a deviation occurs in the detection position of the mark, making it difficult to detect the image forming position with accuracy. Therefore, when the execution conditions of both the displacement correction and the developing bias correction are met, the developing bias correction is executed prior to the displacement correction.

Further, also in the gamma correction, when the above-mentioned density deviation over all levels is present, accurate detection of the density characteristic change of each gradation level for each color becomes difficult. Accordingly, when the gamma correction is executed, the developing bias correction is executed as a set. That is, when the execution condition of the gamma correction is met, the execution condition of the developing bias correction is met. The developing bias correction is executed prior to the gamma correction.

The displacement correction acquires the correction value by detecting an edge of the mark. In acquiring the correction value, a displacement correction mark is formed with the maximum density. Thus, accuracy of the mark density for each gradation level is not required. On the other hand, if a sufficient toner charge amount is not ensured when the mark is formed, the mark itself cannot be formed with a desired density. This results in low reliability of the measurement result and, when the gamma correction is performed based on this measurement result, expression of the gradation is likely to be inappropriate. Thus, when the execution conditions of both the gamma correction and the displacement correction are met, the displacement correction is executed prior to the gamma correction since the toner is agitated also during the displacement correction.

Considering the above combinations of the correction processes, the developing bias correction, the displacement correction, and the gamma correction are performed according to this priority order when the execution conditions of the above correction processes are simultaneously met.

The following describes agitation of the toner performed in the developing device 4. In order for the developing device 4 to stably develop the electrostatic latent image on the photosensitive member 1, the toner charge amount in the developing device 4 is desirably equal to or more than a prescribed amount. Thus, in the printer 100, the toner accommodated in the toner accommodating container 70 needs to be agitated by the agitator 71 before the developing device 4 performs the developing process. Hereinafter, the agitation amount required before the developing process starts is referred to as a specific agitation amount.

The larger the above-mentioned specific agitation amount is, the higher a possibility that the toner charge amount in the developing device 4 becomes equal to or more than the prescribed amount is. However, in this case, start of the image forming is delayed. Excessive agitation increases mechanical stress to the toner and causes deformation of toner particles or degradation of the toner, resulting in degradation of characteristics about charge of the toner. For example, the degradation of the toner is caused by as embedding of additive in the toner. Here, the additive is generally blended in the toner. Thus, in the printer 100 according to the embodiment, the toner is agitated by the specific agitation amount at a stage when the developing process is required. Then, an adequate specific agitation amount is determined using at least one of a toner degradation state, an image (a type of image) to be formed, and a length of a non-agitation time period during which the agitator 71 does not agitate the toner.

Figure 5:
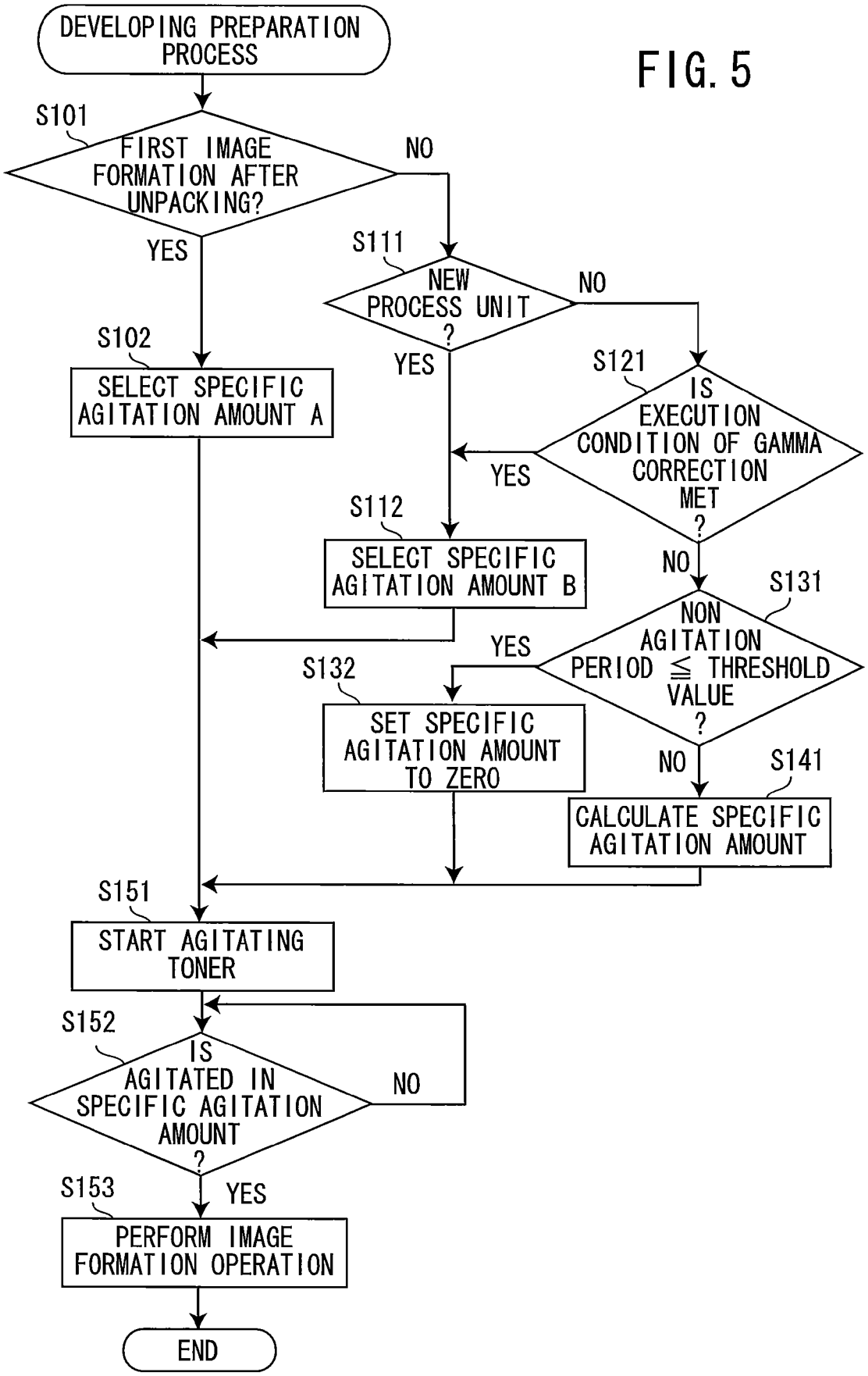
FIG. 5 is a flowchart illustrating a developing preparation process performed by the printer.

FIG. 5 illustrates a procedure of a developing preparation process which is a preparation operation before the printer 100 executes the developing process. The developing preparation process is executed by the CPU 31 when a printing execution condition or a correction execution condition is met, that is, when a condition for performing the developing process is met.

In the developing preparation process, first in S101 the CPU 31 determines whether or not the image forming operation to be executed is the first-time image forming operation after the printer 100 was unpacked by the user. Note that the printer 100 may execute the image forming operation under a maintenance mode before the printer 100 is shipped from a manufacturer. Thus, the first-time image forming operation after the printer 100 was unpacked indicates an image forming operation that is executed at first time by the printer 100 excluding the image forming operation under the maintenance mode. That is, the first-time image forming operation after the printer 100 is not the image forming operation under the maintenance mode. The above determination can be made by referring to a value of a flag that is turned ON at the first-time image forming operation. In this case, the printer 100 is configured to store the flag value in the NVRAM 34 and is shipped in a state where the flag is turned OFF. Because the flag is turned ON after completion of the first-time image forming operation, the CPU 31 can determine whether or not the image forming operation to be executed is the first-time image forming operation after unpackaging by referring to the flag value.

At a time of shipment, the printer 100 does not store various correction values. Alternatively, the printer 100 may store correction values at a time of shipment. However, in this case, because these correction values are obtained in a test environment before shipment, it is probable that these correction values are inappropriate in the present environment. Therefore, at first power-ON after unpackaging, the printer 100 executes all the correction processes (the developing bias correction, the displacement correction, and the gamma correction in the embodiment). Thus, execution conditions of the developing preparation process for performing all the above correction processes are met so as to allow the image forming unit 10 to form the correction marks of all the above correction processes. As described above, the marks for the developing bias correction, the marks for the displacement correction, and the marks for the gamma correction are formed in this order.

The printer 100 may be shipped in a state where the process units 50C, 50M, 50Y, and 50K are mounted therein. In this case, the printer 100 cannot estimate what environment the printer 100 has been exposed to during a time period from when the process units are mounted to when the printer 100 is unpackaged. That is, the toner charge amount decreases with the lapse of time by an electric discharge phenomenon. Further, over a prolonged time, the toner undergoes degradation not only by mechanical stress applied by the agitator 71 or the toner supply roller 62 but also by being exposed to air in which humidity and temperature vary. Thus, the toner charge amount in the printer 100 immediately after unpackaging cannot be estimated.

When the CPU 31 determines that the image forming operation to be executed is the first-time image forming operation after unpackaging (S101: YES), in S102 the CPU 31 assumes that the toner is hardly charged and that the degradation of the toner is progressed to some extent, and selects a specific agitation amount A which is largest agitation amount among a plurality of the specific agitation amounts in the developing preparation process. Thus, in each of the correction processes started after the agitation corresponding to the specific agitation amount A, acquisition of adequate correction values can be expected. In the embodiment, the specific agitation amount A is set to 30 seconds. The process of S102 is an example of determination process.

When the CPU 31 determines that the image forming operation to be executed is not the first-time image forming operation after unpackaging (S101: NO), in S111 the CPU 31 determines whether or not a new process unit 50 is detected. As described above, the process unit 50 includes the movable detected part that is mechanically moved between the first position and the second position. This movable detected part is set to the first position when the process unit 50 is unused (when a new process unit 50 is shipped) and is moved to the second position when the process unit 50 is once used by the printer 100. The mechanical sensor 81 detects the position of the movable part of the process unit 50. By using the detected result of the mechanical sensor 81, the CPU 31 can determine whether the new process unit 50 is mounted in the casing 101. Alternatively, the CPU 31 may determine whether a new toner accommodating container 70 is mounted in the casing 101. In this case, the toner accommodating container 70 includes the movable detected part that is mechanically moved between the first position and the second position. This movable detected part is set to the first position when the toner accommodating container 70 is unused (when a toner accommodating container 70 is shipped) and is moved to the second position when toner accommodating container 70 is once used by the printer 100. The mechanical sensor 81 detects the position of the movable part of the toner accommodating container 70 and by using the detected result of the mechanical sensor 81, the CPU 31 determines whether the new toner accommodating container 70 is mounted in the casing 101. Even when the new process unit 50 is detected, the printer 100 executes all the correction processes (the developing bias correction, the displacement correction, and the gamma correction in the embodiment). Thus, execution conditions of the developing preparation process for performing all the above correction processes are met so as to allow the image forming unit 10 to form the correction marks of all the above correction processes. The developing bias correction, the displacement correction, and the gamma correction are executed in this order.

When determining that a new process unit 50 is detected, the CPU 31 assumes that the toner is not charged, but assumes that degradation of the toner does not occur. Thus, when determining that a new process unit 50 is detected (S111: YES), in S112 the CPU 31 selects a specific agitation amount B which is smaller than the above specific agitation amount A. The specific agitation amount B is set to 20 seconds. The process of S112 is an example of the determination process.

The specific agitation amount A, the specific agitation amount B, and the default value of the specific agitation amount have the following relationship.

Specific agitation amount $A$>specific agitation amount $B$>default value of specific agitation amount When determining that a new process unit 50 is not detected (S111: NO), in S121 the CPU 31 determines whether or not the execution condition of the gamma correction is met. The differences in densities (gradations) among the marks need to be expressed with higher accuracy in the gamma correction than differences in densities in the other correction processes. In order to express differences in the densities among the marks with high accuracy, an adequate toner charge amount needs to be ensured. Thus, when determining that the execution condition of the gamma correction is met (S121: YES), in S112 the CPU 31 selects the specific agitation amount B from among the plurality of the specific agitation mounts. Note that the developing bias correction is executed before the gamma correction.

When determining that the execution condition of the gamma correction is not met (S121: NO), in S131 the CPU 31 determines whether or not the non-agitation time period during which the agitator 71 has not agitated the toner is shorter than or equal to a threshold value. When determining that the non-agitation time period is shorter than or equal to the threshold value (S131: YES), the CPU 31 can assume that agitation of the specific agitation amount has been performed recently and thus the toner charge amount is in a stable state. Therefore, in S132 the CPU 31 sets the specific agitation amount to 0 (zero). In this case, the image forming operation is started without performing agitation of the specific agitation amount. The process S132 is an example of the determination process.

When determining that the non-agitation time period is longer than the threshold value (S131: NO), in S141 the CPU 31 calculates the specific agitation amount and sets the calculated specific agitation amount. The process of S141 is an example of the determination process. Specifically, as represented by the following expression (I), the specific agitation amount is proportional to a length of the non-agitation time period.

$$\text{Specific agitation amount} = \alpha \times \text{length of non-agitation time period} \quad \text{(I)}$$

In the expression (I), $\alpha$ is a constant value. That is, in S141, the specific agitation amount is set such that the longer the length of the non-agitation time period, the larger the specific agitation amount becomes.

A toner discharge amount or water content in the toner accommodating container 70 changes depending also on temperature and humidity, resulting in a variation in the toner charge amount. The CPU 31 may record an environment history, for example, temperature and humidity detected by the sensor 82, in the RAM33 or the NVRAM 34, and may use the environment history (history of temperature, humidity, or etc.) when determining the specific agitation amount.

For example, the higher the humidity in a surrounding environment, the higher the humidity inside the toner chamber becomes. The higher the humidity inside the toner chamber, the more likely the toner particles are to be adhered to each other, thereby causing the toner degradation. As the toner degradation progresses, a variation in charge amount among the individual toner particles becomes large, so that the specific agitation amount needs to be increased in order to ensure a stable charge amount. Thus, the humidity is reflected on the length of the non-agitation time. Specifically, as represented by the following expression (II), a history of the humidity during the non-agitation time is calculated by integration.

$$\text{Length of non-agitation time period} = \beta \times \int (H \cdot T) dT \quad \text{(II)}$$

In the expression (II), $\beta$ is a correction coefficient, H is a humidity, and T is a time. An average temperature and an average humidity during the non-agitation time may be acquired and reflected as environment information on the length of the non-agitation time period.

The larger the total agitation amount by the agitator 71 is, the higher the mechanical stress to be applied to the toner becomes. When the mechanical stress is applied to the toner, deformation of the toner particles or embedding of an external additive in the toner is likely to occur. That is, the larger the total agitation amount, the more likely the toner is degraded. As the toner degradation progresses, characteristics about charge of the toner becomes worse, and the agitation amount needs to be increased in order to stabilize the charge amount. Therefore, the length of the non-agitation time may be weighted such that the larger the amount (the number) of total rotations by the agitator 71, the larger the specific agitation amount becomes.

A value of α or β may be changed depending on an image to be formed. That is, an image (other than the marks) to be printed onto the sheet is an image provided to a user and the quality of the image is desirable to be higher than the quality of the correction mark. In the displacement correction, it is only necessary to determine presence or absence of the mark, and the density of the mark needs not be detected with high accuracy. Thus, in the displacement correction, image quality of the correction mark need not be higher than that in the density correction such as the developing bias correction and the gamma correction. Thus, a value of α or β may be changed so as to satisfy the following relationship.

Quality of image to be printed onto sheet>quality of density correction mark>quality of displacement correction mark That is, the value of α or β may be determined such that the length of non-agitation time period increases in the order of a case where the marks of the displacement correction are printed, a case where the marks of the density correction are printed, and a case where the image that is different from the marks (that is, the image other than the marks) is printed on the sheet. That is, the specific agitation amount increases in the order of the case where the marks of the displacement correction are printed, the case where the marks of the density correction are printed, and the case where the image that is different from the marks (that is, the image other than the marks) is printed on the sheet. Note that, in the embodiment, the CPU 31 sets the specific agitation amount B in S112 when the gamma correction is performed (S121: YES), and thus the process S141 is not performed when determining the specific correction amount for the gamma correction. However, in this modification, the process S121 is not performed, and thus if the negative determination is made in S111, the process directly proceeds to the determination S131. And, if the negative determination is made in S131, the process proceeds to S141. In S141, the length of non-agitation time period and the specific agitation amount are determined dependent on the type of the correction process to be performed by using the value of α or β. According to this configuration, the CPU 31 sets the specific agitation amount of the gamma correction in S141.

A toner consumption amount for forming the marks of the gamma correction is larger than that for forming the marks of the displacement correction, and therefore an execution number of times of the gamma correction is set so as to be small. Accordingly, acquired correction values of the gamma correction may be used in the image forming operation a number of times. Further, high accuracy is required for the densities of the marks in order to acquire accurate correction values. Thus, the length of the non-agitation time period may be weighted such that the specific agitation amount is set larger in a case where the marks of the gamma correction is formed than a specific agitation amount set in a case where the image (other than the marks) is printed onto the sheet.

In a case where the image (other than marks) to be printed onto the sheet, the length of the non-agitation time period may be weighted based on an acceptable time length as a standby time until the printing is started. For example, when a print job is received through the communication interface 37, it is assumed that a user will move to an installation position of the printer 100. Accordingly, a relatively long time length is acceptable as a standby time until the printing is started. On the other hand, when a print job is received through the operation portion 40, it is assumed that a user is in front of the printer 100. In this case, a relatively short time length is acceptable as a standby time until the printing is started. Thus, when it is determined that a long time length is acceptable as a standby time until the printing is started based on an interface (the communication interface 37 or the operation portion 40, for example) through which the print job is received, the length of the non-agitation time may be weighted so as to increase the specific agitation amount. That is, the longer the acceptable time length is as a standby time until the printing is started, the larger specific agitation amount the CPU 31 sets.

Further, the length of the non-agitation time may be weighted according to required quality of the image to be formed. That is, when high-quality printing mode is required, the specific agitation amount may be larger than a specific agitation amount set for quality printing modes other than the high-quality printing mode.

After the processes of S102, S112, S132, or S141, in S151 the CPU 31 starts agitation by the agitator 71. After the process of S151, in S152 the CPU 31 determines whether or not the agitation corresponding to the set (selected) specific agitation amount is completed. When determining that the agitation corresponding to the set specific agitation amount is not completed (S152: NO), the CPU 31 waits until the agitation corresponding to the specific agitation amount is completed.

When determining that the agitation corresponding to the set specific agitation amount is completed (S152: YES), in S153 the CPU 31 starts the image forming operation by using the image forming unit 10. For example, the image forming operation to be executed is the first-time image forming operation after the printer 100 is unpacked or after a new process unit 50 is detected, the marks of the developing bias correction is printed, for example. When a print job is received in a state where the execution condition of the correction process is not met, an image (other than marks) is printed onto the sheet. The process of S153 is an example of an image forming process.

Figure 6:
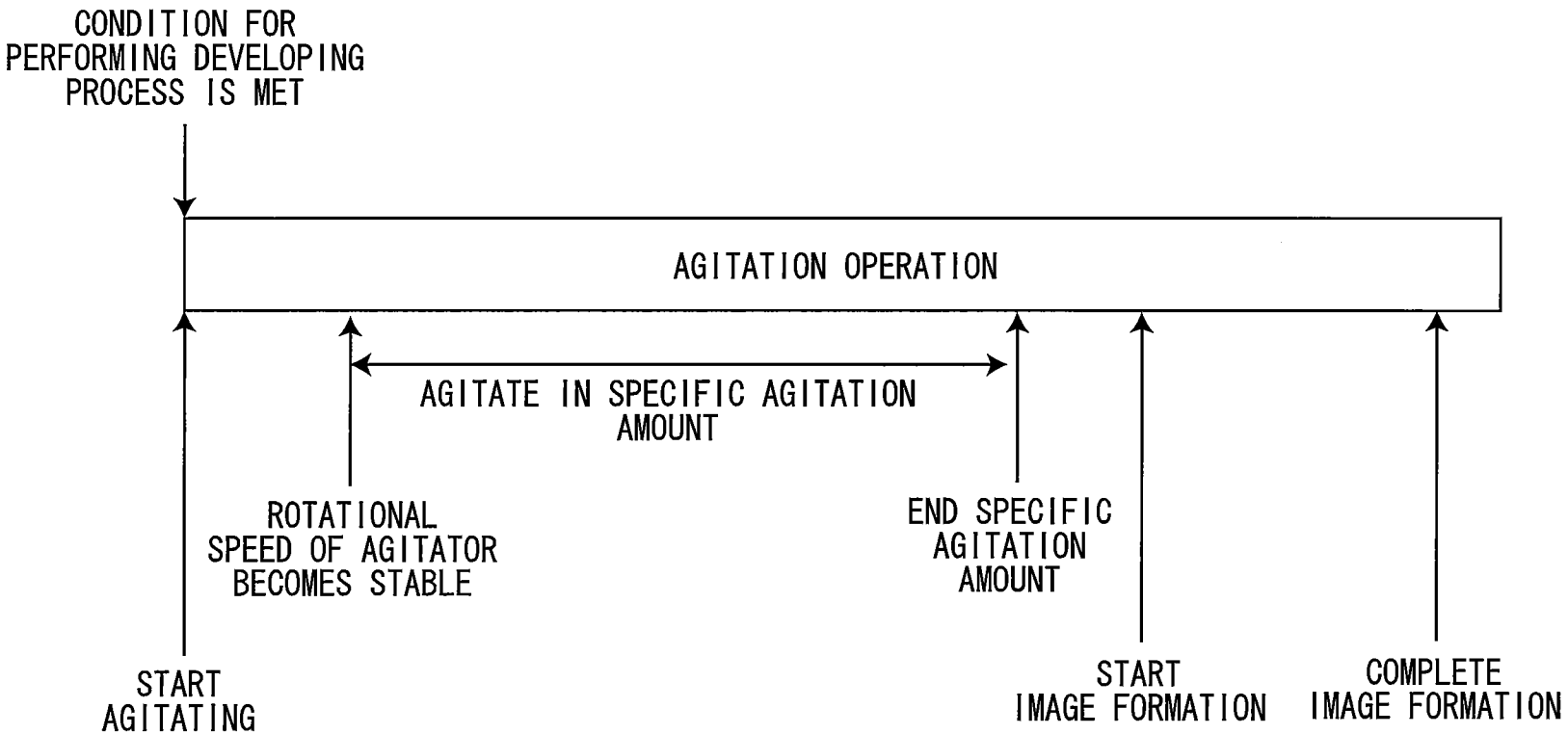
FIG. 6 is a timing chart illustrating an agitation operation and its agitation amount according to the embodiment.

Even after completion of the agitation corresponding to the specific agitation amount, the agitation is continued during the image forming operation. That is, as illustrated in FIG. 6, completion of the agitation corresponding to the specific agitation amount means completion of the agitation corresponding to an agitation amount required for adjusting the toner charge amount before the image forming operation and does not mean that the agitation is not performed thereafter. The agitation corresponding to the specific agitation amount is started after a rotation speed of the agitator becomes stable. The developing preparation process is ended after the process of S153.

As described above, in the printer 100 according to the present embodiment, the specific agitation amount is determined using factors, such as the non-agitation time period of the toner, the toner degradation state, and an image to be formed, that cause a variation in the toner charge amount. Thus, as compared to a case where the specific agitation amount is a fixed value, a more adequate specific agitation amount can be ensured.

While the invention has been described in detail with reference to the embodiment thereof, it would be apparent to those skilled in the art that various changes and modifications may be made therein without departing from the scope of the invention.

For example, the image forming apparatus is not limited to the printer 100 but may be a copy machine, a facsimile machine, a multifunction peripheral, or apparatuses having a printing functions. In the embodiment, the printer 100 is a color printer having the process units 50Y, 50M, 50Y, and 50K corresponding to cyan, magenta, yellow, and black. However, the printer 100 may be a monochrome printer having a single process unit.

Although the specific agitation amount is determined through a plurality of determination processes of S101, S111, S121, and S131 in the embodiment, all the determination processes need not be performed. That is, by performing at least one of the above determination processes, a more adequate specific agitation amount can be ensured as compared to a case where the specific agitation amount is a fixed value.

The execution condition of the correction process, such as the displacement correction, may include a condition that a printing condition for forming an image (other than marks) onto the sheet is met. That is, satisfying the execution condition means that at least the printing condition is satisfied. Accordingly, when the execution condition of the correction is met, the condition for printing on the sheet (other than marks) is inevitably met. Thus, after completion of the agitation corresponding to the specific agitation amount required for forming the marks, the marks are formed, and then an image (other than marks) is formed on the sheet. In this case, before the image (other than marks) is printed onto the sheet, the agitation is performed in at least a sum of the specific agitation amount for the marks and an agitation amount during the marks are formed. If a required agitation amount required for the image (other than the marks) to be printed onto the sheet is larger than the sum of the specific agitation amount for the marks and the agitation amount during the marks are formed, the agitation is further performed in the difference of the agitation amount obtained by subtracting the sum from the agitation amount required for the image (other than marks) to be printed onto the sheet after the marks are formed, and subsequently the image (other than marks) is formed onto the sheet. On the other hand if the agitation amount required for the image (other than marks) to be printed onto the sheet is less than or equal to the sum, the image (other than marks) is formed onto the sheet immediately after the marks are formed.

Any process described in the embodiment may be performed by a single CPU, a plurality of CPUs, hardware such as ASIC, and any combination thereof. The processes described above may be implemented by a non-transitory computer readable storage medium storing a set of program instructions, or other manners.

What is claimed is:

1. An image forming apparatus comprising:

a container accommodating toner;

an image forming portion configured to form a mark for a correction process by using the toner in the container and an image based on a print instruction by using the toner in the container;

an agitator configured to agitate the toner in a target agitation amount before the image forming portion forms the mark, the target agitation amount representing an amount of actions of agitation imparted upon the toner by the agitator; and a processor configured to:

obtain a non-agitation time period during which the agitator has not agitated the toner;

set the target agitation amount based on the non-agitation time period, wherein the longer the non-agitation time period is, the larger target agitation amount the processor sets;

perform agitating the toner in the target agitation amount by the agitator; and control the image forming portion to form the mark after the agitator agitates the toner in the target agitation amount.

2. The image forming apparatus according to claim 1, wherein the processor sets the target agitation amount based on both the non-agitation time period and humidity.

3. An image forming apparatus comprising:

a container accommodating toner;

an image forming portion configured to form an image based on a print instruction by using the toner in the container, a mark by using the toner in the container for a gamma correction that corrects characteristics about change of densities to be formed, and a mark by using the toner in the container for a displacement correction that corrects position of the image to be formed by controlling the image forming portion;

an agitator configured to agitate the toner in a target agitation amount before the image forming portion forms the mark for the gamma correction or the mark for the displacement correction, the target agitation amount representing an amount of actions of agitation imparted upon the toner by the agitator; and a processor configured to:

set the target agitation amount larger than the target agitation amount set when the mark for the displacement correction is formed;

perform agitating the toner in the target agitation amount by the agitator; and control the image forming portion to form the mark for the gamma correction after the agitator agitates the toner in the target agitation amount.

4. The image forming apparatus according to claim 3, wherein the processor is further configured to:

determine whether a new container is detected, wherein when the mark for the gamma correction is formed at first time after a new container is detected, the processor sets the target agitation amount larger than the target agitation amount set when an image that is different from the mark for the gamma correction is formed on a sheet.

5. The image forming apparatus according to claim 4, wherein when the mark for the gamma correction is formed at first time after the image forming apparatus is shipped from a manufacturer and unpacked, the processor sets the target agitation amount larger than the target agitation amount set when the first mark is formed after the new container is detected.

6. The image forming apparatus according to claim 4, further comprising a nonvolatile memory configured to store a first value, wherein the processor is further configured to store the first value in the nonvolatile memory after the image forming portion performs a first image formation excluding an image formation executed under a maintenance mode, wherein when the mark for the gamma correction is formed and the first value is not stored in the nonvolatile memory, the processor sets the target agitation amount larger than the target agitation amount set when the mark for the gamma correction is formed with the first value stored in the nonvolatile memory.

7. The image forming apparatus according to claim 3, further comprising a light-emitting element configured to emit light and a light-receiving element configured to receive light;

wherein when the mark for the gamma correction is formed at first time after the image forming apparatus is shipped from a manufacturer and unpacked, the processor sets the target agitation amount larger than the target agitation amount set when the image that is different from the mark for the gamma correction is formed on a sheet, wherein the processor is further configured to:

emit light to the mark for the gamma correction by the emitting element;

receive a reflected light from the mark for the gamma correction by the receiving element; and adjust a correction value based on the received reflected light.

8. The image forming apparatus according to claim 3, further comprising a nonvolatile memory configured to store a first value, wherein the processor is further configured to store the first value in the nonvolatile memory after the image forming portion performs a first image formation excluding an image formation executed under a maintenance mode, set, when the mark for the gamma correction is formed without storing the first value in the nonvolatile memory, the target agitation amount larger than the target agitation amount set when the image that is different from the mark for the gamma correction is formed on a sheet.

9. The image forming apparatus according to claim 3, wherein the processor is configured to:

form a mark for a developing bias correction that corrects density of the image to be formed irrespective of gradation levels; and set when the mark for the developing bias correction is to be formed, the target agitation amount larger than the target agitation amount set when the mark for the displacement correction is formed.

10. An image forming apparatus comprising:

a nonvolatile memory configured to store a first value;

a container accommodating toner;

an image forming portion configured to form a mark for a correction process by using the toner in the container and an image on a sheet based on a print instruction by using the toner in the container;

an agitator configured to agitate the toner in a target agitation amount before the image forming portion forms the mark for the correction process, the target agitation amount representing an amount of actions of agitation imparted upon the toner by the agitator; and a processor configured to:

store the first value in the nonvolatile memory after the image forming portion performs a first image formation excluding an image formation executed under a maintenance mode;

determine whether the first value being stored in the nonvolatile memory;

set, when the mark for the correction process is formed without storing the first value in the nonvolatile memory, the target agitation amount larger than the target agitation amount set when the mark for the correction process is formed with the first value stored in the nonvolatile memory;

perform agitating the toner in the target agitation amount by the agitator; and control the image forming portion to form the mark for the correction process after the agitator agitates the toner in the target agitation amount.

* * * * *